US008149139B2

(12) United States Patent
Coffee et al.

(10) Patent No.: US 8,149,139 B2
(45) Date of Patent: Apr. 3, 2012

(54) DYNAMIC PRICING FOR TOLL LANES

(75) Inventors: Brett Coffee, Rockwall, TX (US); Marty Lain, Sachse, TX (US)

(73) Assignee: Electronic Transaction Consultants, Richardson, TX (US)

( * ) Notice: Subject to any disclaimer, the term of this patent is extended or adjusted under 35 U.S.C. 154(b) by 351 days.

(21) Appl. No.: 12/476,355

(22) Filed: Jun. 2, 2009

(65) Prior Publication Data

US 2009/0295599 A1 Dec. 3, 2009

Related U.S. Application Data

(60) Provisional application No. 61/058,141, filed on Jun. 2, 2008.

(51) Int. Cl.
*G08G 1/00* (2006.01)

(52) U.S. Cl. ..... 340/928; 235/384; 701/118; 701/119; 705/13

(58) Field of Classification Search ..... 340/928, 340/933, 934, 936; 235/384; 705/13; 701/118, 701/119
See application file for complete search history.

(56) References Cited

U.S. PATENT DOCUMENTS 5,281,964 A 1/1994 Iida et al.
5,506,774 A 4/1996 Nobe et al.
7,320,430 B2 1/2008 Dawson et al.

OTHER PUBLICATIONS

International Search Report issued Jul. 21, 2009, by the ISA/US in connection with International Application No. PCT/US2009/045994, pp. 4.
Written Opinion issued Jul. 21, 2009, by the ISA/US in connection with International Application No. PCT/US2009/045994, pp. 5.
Prosecution History of U.S. Patent No. 7320430, pp. 110.
High Occupancy Tool (HOT) Lane Electronic Toll Collection System Supply, Installation, and Maintenance Project, Appendix D-Dynamic Pricing Algorithm Technical Memorandum, V. 3.0, Oct. 31, 2007, pp. 9, Electronic Transaction Consultants.
High-Occupancy/toll (HOT) lanes and value pricing: A preliminary assessment, Jun. 1998, pp. 7, Institute of Transportation Engineers. ITE Journal.
A Guide for Hot Lane Development, Mar. 2003, pp. 30, U.S. Department of Transportation Federal Highway Administration.
"HCTRA Katy Tollway Concept Overview and System Requirements With Minimum and Maximum Tolls", Wilbur Smith Associates, Feb. 1, 2008, 40 pages.

*Primary Examiner* — Brent Swarthout
(74) *Attorney, Agent, or Firm* — Haynes and Boone. LLP

(57) ABSTRACT

The present invention provides a method and system for determining a toll charge for vehicles traveling on a toll lane that includes determining a change in traffic flow for vehicles traveling on the toll lane, determining a change in traffic speed for vehicles traveling on the toll lane, and determining the toll charge for vehicles traveling on the toll lane using a weighting approach that weights the change in traffic flow with a first factor and weights the change in speed with a second factor, the first factor depending on whether the change in traffic flow is increasing or decreasing, and the second factor depending on whether the change in speed is increasing or decreasing.

22 Claims, 5 Drawing Sheets

DYNAMIC PRICING FOR TOLL LANES

PRIORITY DATA

This application claims priority to Provisional Application Ser. No. 61/058,141 filed on Jun. 2, 2008, entitled "DYNAMIC PRICING FOR TOLL LANES," the entire disclosure of which is incorporated herein by reference.

TECHNICAL FIELD

The present invention relates generally to management of toll lanes, and more specifically, the present invention relates to a method for dynamic pricing for toll lanes.

BACKGROUND

Traffic congestion has been a major issue in many urban areas, and will continue to be so as the number of vehicles increases. Several approaches have been employed to alleviate traffic congestion and address the various problems associated with traffic congestion. For example, High Occupancy Vehicle ("HOV") lanes or carpool lanes have been employed to encourage people to share rides, and thus decrease the amount of vehicles on the roads. However, it is neither practical nor convenient in many cases for people to share rides and the HOV lanes are not efficiently used to their full capacity. As another example, HOV lanes may be transformed into High Occupancy Tolling ("HOT") lanes, and the HOT lanes may used by single-occupancy vehicles that are willing to pay a toll charge to save driving time.

Accordingly, more vehicles may use the HOV lanes that would otherwise have not been able to which may lessen traffic congestion on the corresponding non-HOV lanes or general purpose lanes. The toll charge may vary depending on the time of day (e.g., peak and non-peak periods) and/or the day of the week (e.g., weekdays and weekend). Although these approaches have been satisfactory for their intended purposes, they have not been satisfactory in all respects. One disadvantage is that these approaches are not effectively responsive to real-time changes in traffic conditions which can lead to traffic congestion problems. Further, these approaches are not predictive of oncoming traffic conditions that may also result in traffic congestion problems if not sufficiently addressed in time.

SUMMARY

One of the broader forms of an embodiment of the present invention involves a method of calculating a toll charge for vehicles traveling on a toll lane. The method includes determining a change in traffic flow of vehicles traveling on the toll lane, determining a change in speed of vehicles traveling on the toll lane, and determining the toll charge for vehicles traveling on the toll lane using a weighting approach that weights the change in traffic flow by a first factor and weights the change in speed by a second factor, the first factor depending on whether the change in traffic flow is increasing or decreasing, the second factor depending on whether the change in speed is increasing or decreasing.

Another one of the broader forms of an embodiment of the present invention involves a method of calculating a toll charge for vehicles traveling on a toll lane. The method includes evaluating a change in traffic flow of vehicles traveling on a toll lane to predict how traffic will continue to flow on the toll lane, evaluating a change in traffic speed of vehicles traveling on the toll lane to predict how traffic will continue to speed on the toll lane, and calculating the toll charge for vehicles traveling on a toll lane based on the predicted traffic flow and the predicted traffic speed so that traffic on the toll lane approaches a pre-defined traffic flow and pre-defined traffic speed.

Yet another one of the broader forms of an embodiment of the present invention involves a toll system. The toll system includes a first sensor for sensing a traffic flow of vehicles traveling on a toll lane, a second sensor for sensing a speed of vehicles traveling on the toll lane, and a controller operatively coupled to the first and second sensors for receiving information regarding the traffic flow and speed, and configured to: determine a change in the flow of vehicles, determine a change in the speed of vehicles, and determine a toll charge for vehicles traveling on a toll lane using a weighting approach that weights the change in the traffic flow by a first factor and weights the change in the speed by a second factor, the first factor depending on whether the change in traffic flow is increasing or decreasing, the second factor depending on whether the change in speed is increasing or decreasing.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 1:
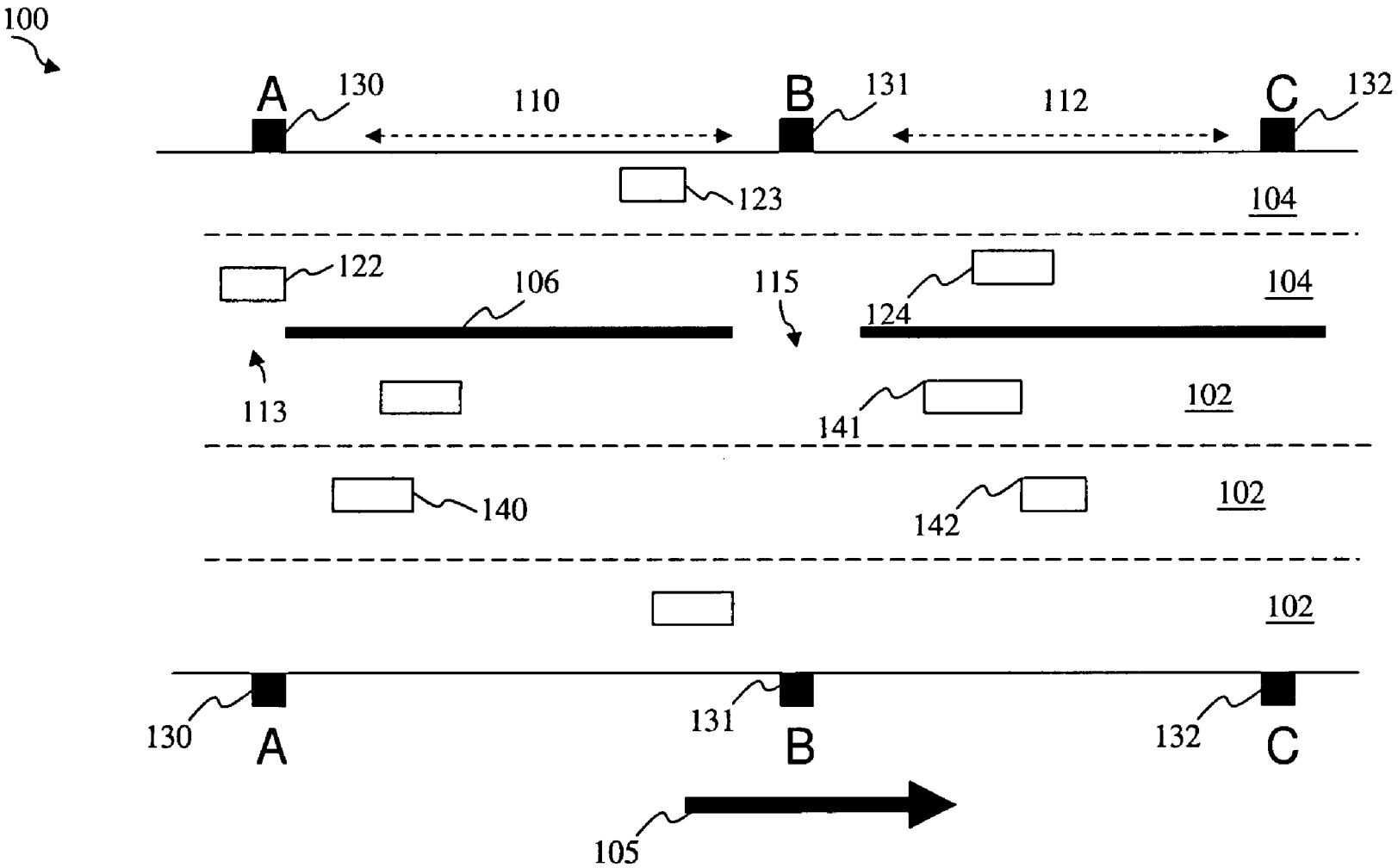
FIG. 1 illustrates a road system having toll lanes and non-toll lanes in which various aspects of dynamic pricing for the toll lanes may be implemented.

Referring to FIG. 1, illustrated is a top view of a road system 100 having non-toll lanes (e.g., general purpose lanes) 102 and toll lanes (e.g., managed lanes) 104 for travel in a single direction 105. The non-toll lanes 102 may be separated from the toll lanes 104 by a median barrier 106 or other suitable separating structure. The road system 100 may be further divided into a road segment 110 that is between markers A and B, and a road segment 112 that is between markers B and C. The road system 100 may further include access points 113, 115 for entering and exiting the toll lanes 104 of segments 110 and 112, respectively. A display (not shown) may be located near the access points 113, 115 to notify motorists of a toll charge for using the toll lanes 104 of the respective segments 110 and 112. The toll charge may vary depending on the traffic conditions of the non-toll lanes 102 and toll lanes 104 as will be discussed later herein. It is understood that the number of non-toll and toll lanes, number of segments, and distance of the segments may vary depending on the design requirements and constraints of the road segment.

Vehicles 122, 123, 124 that desire to travel on the toll lanes 104 may each require a toll transponder (e.g., toll tag) or other suitable device that is able to communicate with a reader located at the access points 113, 115. The transponders may communicate with the reader over the air using RF signals or other suitable wireless communication technology known in the art. Accordingly, the reader may obtain information from the transponder, and bill the toll charge to an account associated with the transponder. A plurality of sensors 130, 131, 132 may be located at each marker A, B, C for determining traffic conditions on the non-toll lanes 102 and toll lanes 104. For example, the sensors 130, 131, 132 may be used to determine traffic speed and traffic flow of vehicles 122, 123, 124 traveling on the toll lanes 104 and of vehicles 140, 141, 142 traveling on the non-toll lanes 102, as will be discussed later herein. The traffic information may be collected and determined periodically (e.g., 5 seconds), and the information may be sent to a toll system to determine the toll charge for the toll lanes 104 of the respective segments 110, 112. It is understood the number of sensors used and the location of the sensors may vary depending on the design requirements of the road system 100. For example, multiple sensors may be positioned along road segments 110, 112, and traffic information from the sensors may be averaged to provide more accurate data.

Vehicles 122, 123, 124 that desire to travel on the toll lanes 104 may each require a toll transponder (e.g., toll tag) or other suitable device that is able to communicate with a reader located at the access points 113, 115. The transponders may communicate with the reader over the air using RF signals or other suitable wireless communication technology known in the art. Accordingly, the reader may obtain information from the transponder, and bill the toll charge to an account associated with the transponder. A plurality of sensors 130, 131, 132 may be located at each marker A, B, C for determining traffic conditions on the non-toll lanes 102 and toll lanes 104. For example, the sensors 130, 131, 132 may be used to determine traffic speed and traffic flow of the vehicles 122, 123, 124 traveling on the toll lanes 104 and of the vehicles 140, 141, 142 traveling on the non-toll lanes 102, as will be discussed later herein. The traffic information may be collected and determined periodically (e.g., 5 seconds) and the information may be sent to a toll system to determine the toll charge for the toll lanes 104 of the respective segments 110, 112 or some combination of the segments 110, 112. It is understood the number of sensors used and the location of the sensors may vary depending on the design requirements of the road system 100. For example, multiple sensors may be positioned along road segments 110, 112, and traffic information from the sensors may be averaged to provide more accurate data.

Figure 2:
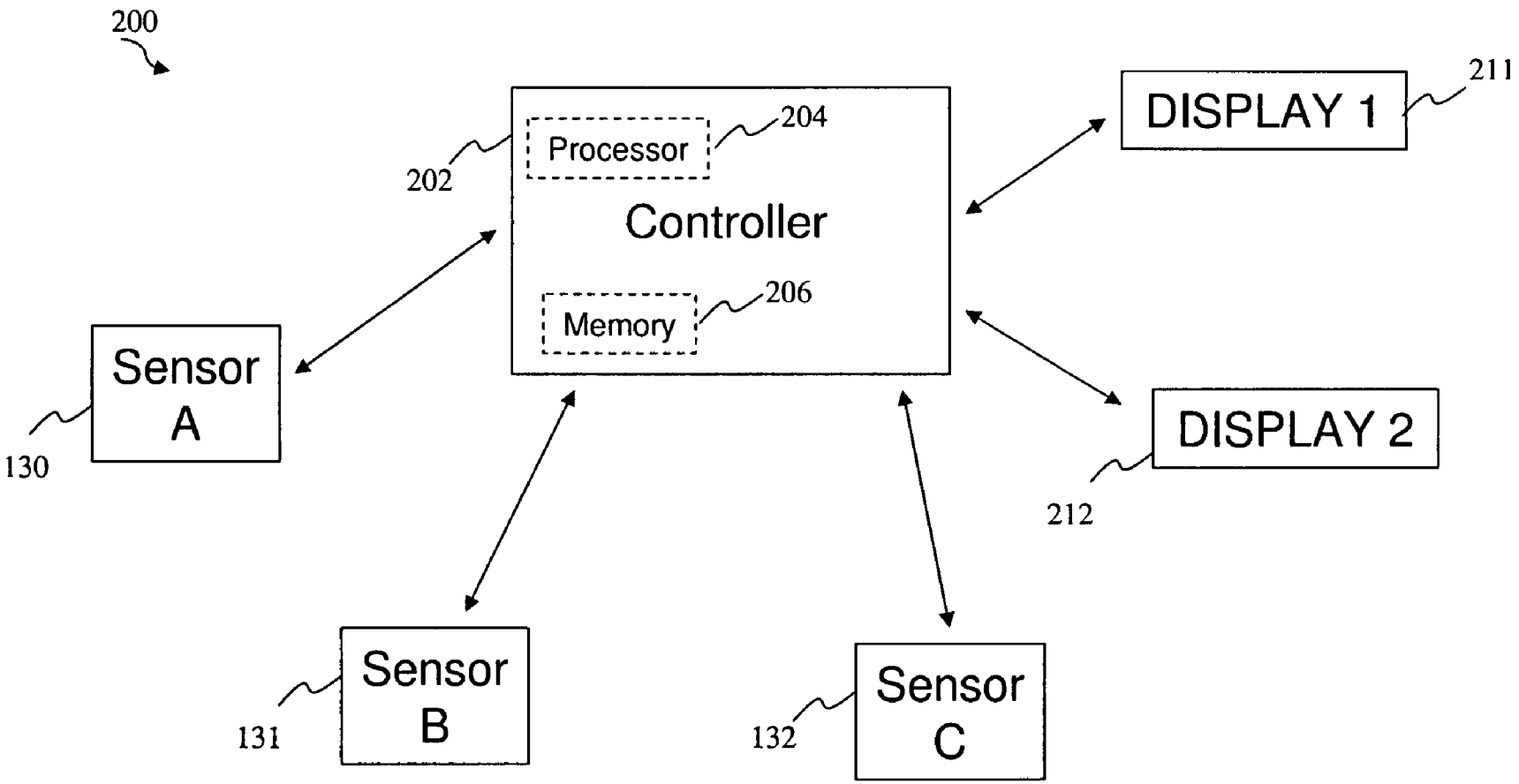
FIG. 2 illustrates a toll system for processing traffic information on the road segment of FIG. 1 and for dynamic pricing for the toll lanes.

Referring also to FIG. 2, illustrated is a toll system 200 for processing traffic information and determining a toll charge for vehicles 122, 123, 124 traveling on the toll lanes 104 of road segments 110 and 112 of FIG. 1. Similar features in FIGS. 1 and 2 are numbered the same for the sake of clarity and simplicity. The toll system 200 may include a controller 202 for controlling the operations and functionality of the toll system. The controller 202 may include a processor 204 such as a computer, microcontroller, digital machine, or other suitable processing device known in the art. The controller 202 may further include memory 206 for storing various computer programs to be executed by the processor 204 and for storing traffic information and/or other data. For example, traffic information may be collected and stored in history tables to identify traffic patterns and trends that may be used in predicting oncoming traffic conditions as will be discussed later herein.

The controller 202 may receive traffic information from the sensors 130, 131, 132 located near each marker A, B, C of FIG. 1. The sensors 130, 131, 132 may collect traffic information, such as traffic speed and traffic flow, on each of the toll lanes 102 and on each of the non-toll lanes 104, and communicate the information to the controller 202 via a wired or wireless connection. The controller 202 may be coupled to displays 211, 212 that are located near the access points 113, 115 to notify motorists of the toll charge for using the toll lanes 104 in FIG. 1.

The memory 206 may include a dynamic pricing algorithm that is executed by the processor 204 to determine the toll charge for vehicles 122, 123, 124 using the toll lanes 104. The toll charge may be calculated and updated every 5 minutes, 10 minutes, or any other suitable user-defined interval, and may be displayed on displays 211, 212 to notify motorists of the toll charge. Further, the user-defined interval may be varied such that shorter intervals may be used during peak periods (e.g., rush hour) whereas longer intervals may be used during non-peak periods (e.g., after midnight). Also, the interval may be varied depending on the traffic information such as where the traffic information (e.g., the change in traffic flow has abnormally increased or the change is traffic speed has abnormally decreased) may predict oncoming traffic problems such as an accident or other emergency situation. The dynamic pricing algorithm uses a weighted approach based on traffic flow and traffic speed of the toll lanes 104 and/or non-toll lanes 102 to determine an amount by which to adjust the current toll charge. Further, the dynamic pricing algorithm uses changes in traffic flow and changes in traffic speed to predict oncoming traffic conditions, and adjusts the toll charge to try to control both traffic flow and traffic speed in the toll lanes 104. Accordingly, the dynamic pricing algorithm may be responsive to the predicted oncoming traffic conditions, and adjust the toll charge to maintain an optimum traffic flow and optimum traffic speed (e.g., user-defined parameters) on the toll lanes 104 at all times.

In one embodiment, the toll lanes 104 may be configured as High Occupancy Vehicle lanes that may be used free of charge for vehicles having two or more occupants. Additionally, the toll lanes 104 may also be configured as High Occupancy Tolling ("HOT") lanes that may be used by single-occupancy vehicles that do not qualify to travel free of charge on the HOV lanes but are willing to pay the toll charge to save travel time. This is known as "value pricing" where the amount that a person would be willing to pay depends on the potential travel time that can be saved using the toll lanes 104 (e.g., managed lanes) instead of the non-toll lanes 102 (e.g., general purpose lanes). Thus, traffic flow and traffic speed may be controlled by adjusting the toll charge via the dynamic pricing algorithm to encourage or deter motorists from using the toll lanes 104. For example, motorists may be deterred from using the toll lanes 104 as the toll charge approaches a maximum rate, and motorists may be encouraged to use the toll lanes 104 as the toll charge approaches a minimum rate.

As discussed above, the sensors 130, 131, 132 may collect traffic information on each of the non-toll lanes 102 and on each of the toll lanes 104, and provide the traffic information to the processor 202. For example, traffic flow may be defined as the rate at which vehicles pass over a given point or section of a lane during a given interval of time (e.g., one hour or less). The traffic flow data that is obtained at each marker A, B, C for the toll lanes 104 may be averaged to determine an average traffic flow for the toll lanes, and the traffic flow for the non-toll lanes 102 may be averaged to determine an average traffic flow for the non-toll lanes. Alternatively, the traffic flow for the non-toll lanes 102 and toll lanes 104 may be determined for a particular road segment such as segments 110, 112 instead of at a given point such as marker A, B, C. Traffic speed may defined as a rate of motion expressed as distance per unit of time (e.g., miles per hour).

Accordingly, the traffic speed data that is obtained at each marker A, B, C for the toll lanes 104 may be averaged to determine an average traffic speed for the toll lanes, and the traffic speed for the non-toll lanes 102 may be averaged to determine an average traffic speed for the non-toll lanes.

In the toll system, traffic flow may be used as a leading indicator to traffic speed. Also, the rate of change in traffic flow may used as a leading indicator to how traffic flow will continue to change in future time intervals. Similarly, the rate of change in traffic speed may be used as a leading indicator to how traffic speed will continue to change in future time intervals. By evaluating the current states of both traffic flow and traffic speed, the dynamic pricing algorithm will work to predict oncoming traffic conditions and adjusts the current toll charge to try to control the traffic flow and traffic speed in the toll lanes 104. As such, the optimum traffic flow and optimum traffic speed in the toll lanes 104 can be maintained as specified by the operator of the road system. Additionally, the traffic patterns and trends may be used to evaluate the currents states of traffic flow and traffic speed to further predict oncoming traffic conditions on the toll lanes 104 as well as the non-toll lanes 102.

For example, the traffic information on the toll lanes 104 may indicate that the change in traffic flow has been increasing by a large amount in a short time period and/or the change in traffic speed has been decreasing by a large amount in a short time period which may predict an oncoming traffic congestion problem on the toll lanes. Thus, the dynamic pricing algorithm may adjusts the toll charge to deter motorists from entering the toll lanes 104, and thus may alleviate some of the traffic congestion that was predicted by the traffic information. Accordingly, the dynamic pricing algorithm is effectively responsive to real-time changes in traffic conditions that predicts oncoming traffic conditions and adjusts the current toll rate to control both the traffic flow and traffic speed in the toll lanes 104. It is understood that the toll charge for using the toll lanes 104 of segment 110 may be the same as or may be different than the toll charge for using the toll lanes 104 of segment 112.

Figure 3:
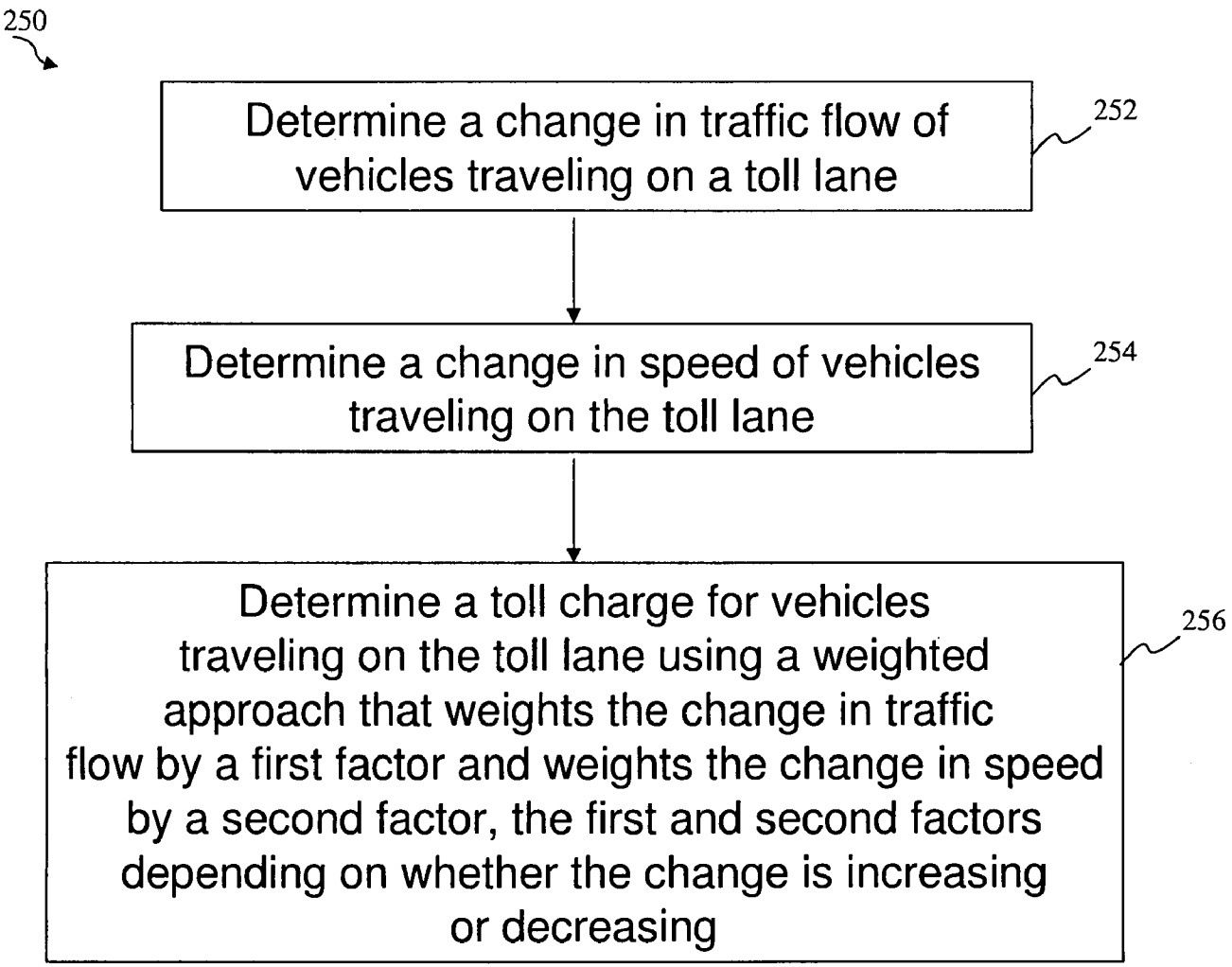
FIG. 3 illustrates a flow chart of a method of calculating a toll charge for vehicles traveling on a toll lane according to various aspects of the present disclosure.

Referring to FIG. 3, illustrated is a flow chart of a method 250 for calculating a toll charge for vehicles traveling on a toll lane. The method 250 begins with block 252 in which a change in traffic flow of vehicles traveling on a toll lane is determined. The method 250 proceeds with block 254 in which a change in speed of vehicles traveling on the toll lane is determined. The method 250 proceeds with block 256 in which a toll charge for vehicles traveling on the toll lane is determined using a weighted approach. The approach weights the change in traffic flow by a first factor and weights the change in speed by a second factor. The first and second factors are dependent on whether the change is increasing or decreasing. An example of implementation of the method 250 is described in detail below with reference to a dynamic pricing algorithm. Also, it should be noted that the toll calculation may incorporate the change in traffic flow and speed of vehicles traveling on the non-toll lane that runs parallel the toll lane as will be discussed below.

The table below is a list of abbreviations that are used in the dynamic pricing algorithm discussed below.

| | |
|---|---|
| GP | General Purpose Lane |
| ML | Managed Lane |
| S | Speed |
| S' | Change in Speed |
| SCF | Speed Change Factor |
| Smax | Maximum Speed |
| Smin | Minimum Speed |
| So | Optimum Speed |
| Sp | Speed Weighting Factor Percentage |
| SWF | Speed Weighting Factor |
| T | Toll Rate |
| TIM | Toll Increment Multiplier |
| TIMgp | General Purpose Lanes Toll Increment Multiplier |
| TIMml | Managed Lanes Toll Increment Multiplier |
| Tinc | Toll Increment |
| Tmax | Maximum Toll |
| Tmin | Minimum Toll |
| Tscale | Toll Increment Multiplier Scale |
| v | Flow |
| v' | Change in Flow |
| vCF | Flow Change Factor |
| vmax | Maximum Flow |
| vmin | Minimum Flow |
| vo | Optimum Flow |
| vp | Flow Weighting Factor Percentage |
| vscale | Flow Scale |
| vWF | Flow Weighting Factor |
| Wgp | General Purpose Lane Weighted Average |
| Wml | Managed Lane Weighted Average |
| Wscf | Speed Change Factor Weighted Average |
| Wvcf | Flow Change Factor Weighted Average |

The dynamic pricing algorithm determines the amount by which to adjust the current toll rate by calculating a Toll Increment Multiplier ("TIM") which is applied to a pre-defined Toll Increment ("Tinc") parameter such as $0.25, $0.50, etc. Accordingly, the toll rate ("T") may be defined by the following equation:

$$T(t)=T(t-1)+\text{TIM}*T\text{inc}$$

T(t) represents the current toll rate and T(t−1) represents the previous toll rate. The toll rate (T) may be determined and updated at a user-defined interval such as every 10 minutes or any other suitable time interval as discussed above.

TIM is based on traffic flow ("v"), traffic speed ("S"), change in traffic flow ("v'"), and change in traffic speed ("S'"). Additionally, optimum traffic flow ("vo"), maximum traffic flow ("vmax"), optimum speed ("So"), and minimum speed ("5 min") are user-defined and configurable parameters that are used to optimally tune the algorithm. Accordingly, the algorithm may hit the maximum toll rate upon reaching either maximum flow (vmax) or minimum speed (Smin). Further, to help manage the toll rate (T), the algorithm has configurable upper and lower thresholds defined as Toll Max (Tmax) and Toll Min (Tmin) that limit the possible toll rate values. The algorithm may continue to calculate higher or lower toll rates outside these thresholds, but these toll rates will not be displayed.

The TIM is calculated as a weighted average based on a change factor for traffic flow and traffic speed, Flow Change Factor ("vCF") and Speed Change Factor ("SCF"), respectively. These change factors have independently weighting values defined as Weight of vCF ("Wvcf") and Weight of SCF ("Wscf"). By use of the configurable weighting factors, traffic flow (v) can be given more or less emphasis than traffic speed (S) or vice versa. Additionally, a factor, Tscale, may be used to scale TIM to a value that represents the desired level of change and to tune the algorithm. For example, it may be desired to increase the toll rate to a maximum toll charge to try to alleviate a predicted oncoming traffic problem corresponding to the Flow Change Factor (vCF) and/or Speed Change Factor (SCF). Accordingly, the TIM can be defined by the following equation:

$$TIM=(vCF*Wvcf+SCF*Wscf)*Tscale, \text{ where } Wvcf+Wscf=1$$

The flow change factor (vCF) is the product of the change in flow (v') and the Flow Weighting Factor (vWF). The product may be scaled ("vscale") down to a range equivalent to the speed change factor (SCF) by the ratio of the optimum flow (vo) to the optimum speed (So). Accordingly, the flow change factor may be defined by the following equation:

$$vCF=(v'*vWF)/vscale, \text{ where } v'=v(t)-v(t-1) \text{ and } vscale=vo/So$$

Figure 4:
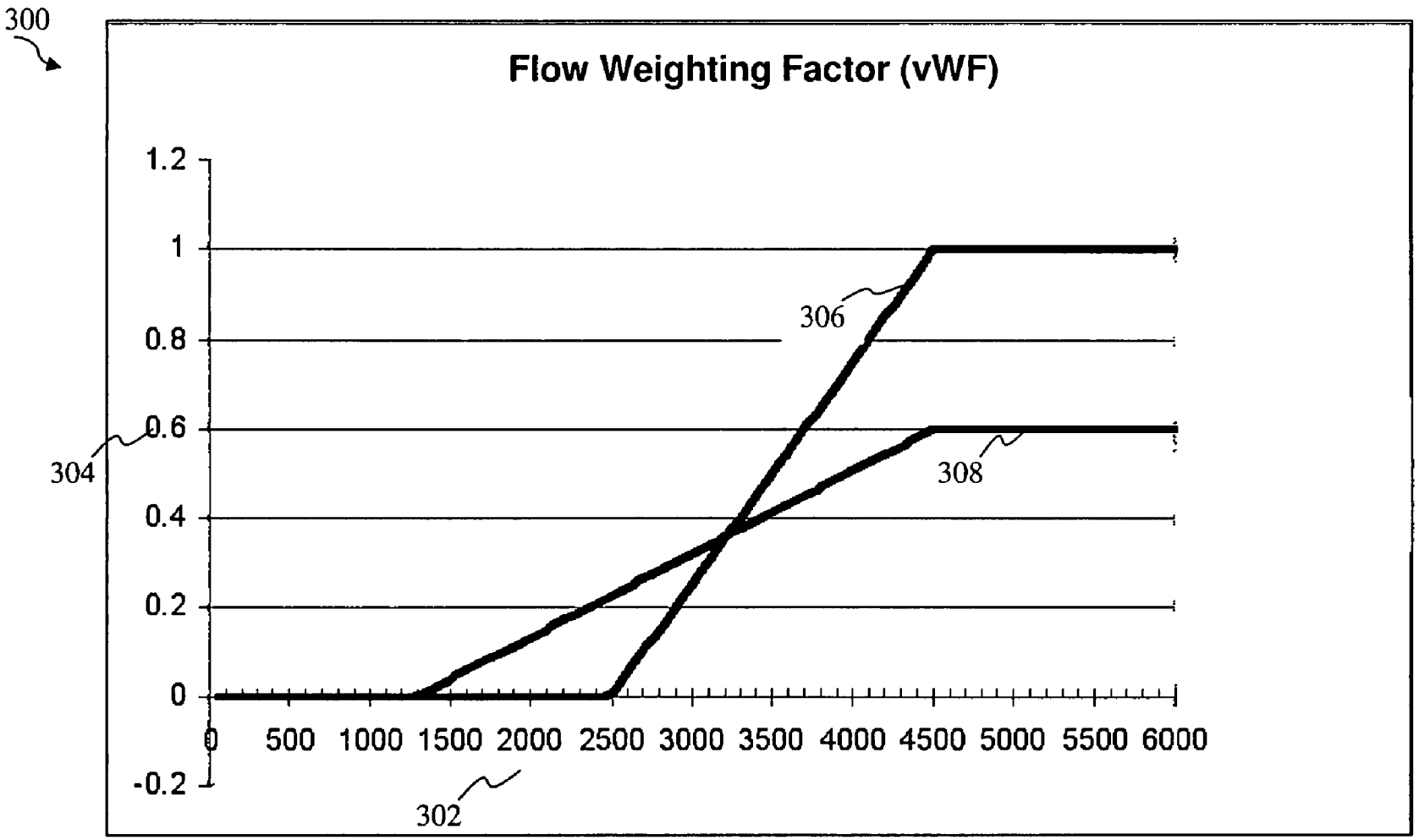
FIG. 4 illustrates a relationship between traffic flow and a flow weighting factor that may be used in dynamic pricing for toll lanes in FIG. 1.

Referring also to FIG. 4, illustrated is a graph 300 showing the relationship between traffic flow 302 and the Flow Weighting Factor 304. The graph 300 may be used to determine the Flow Weighting Factor (vWF) for a particular traffic flow value. It should be noted that the Flow Weighting Factor (vWF) is sensitive to the current value of traffic flow. Accordingly, changes at a traffic flow near the optimum flow (vo) condition are weighted more heavily than changes near the minimum traffic flow (vmin) condition. To alleviate abrupt decreases in the toll rate caused by unstable conditions, the graph 300 includes a function 306 that is used when the change in traffic flow (v') indicates that traffic flow is increasing, and a function 308 that is used when the change in traffic flow (v') indicates that traffic flow is decreasing. The function 308 may have a maximum value that is defined as a percentage (vp) of the increasing vWF function 306. The graph 300 may be represented by the following equations:

if v>vmin and v'>=0, $$vWF=(v-vmin)/(vo-vmin)$$

if v>vmin and v'<0, $$vWF=[vp/(vo+1-Vmin-vp)]*v(t-1)-[vp/(vo+1-vmin-vp)]*(-1+Vmin+vp)$$

if v<=vmin, $$vWF=0$$

if v>=vo, $$vWF=1$$

The following graph 300 represents increasing (+) vWF and decreasing (−) vWF given vo=4500, vmin=2500, and vp=60%.

The speed change factor (SCF) is calculated in a similar manner as the flow change factor (vCF) discussed above. The SCF is the product of the change in speed (S') and the Speed Weighting Factor (SWF). Accordingly, the speed change factor may be defined by the following equation:

$$SCF=-S'*SWF, \text{ where } S'=S(t)-S(t-1)$$

Figure 5:
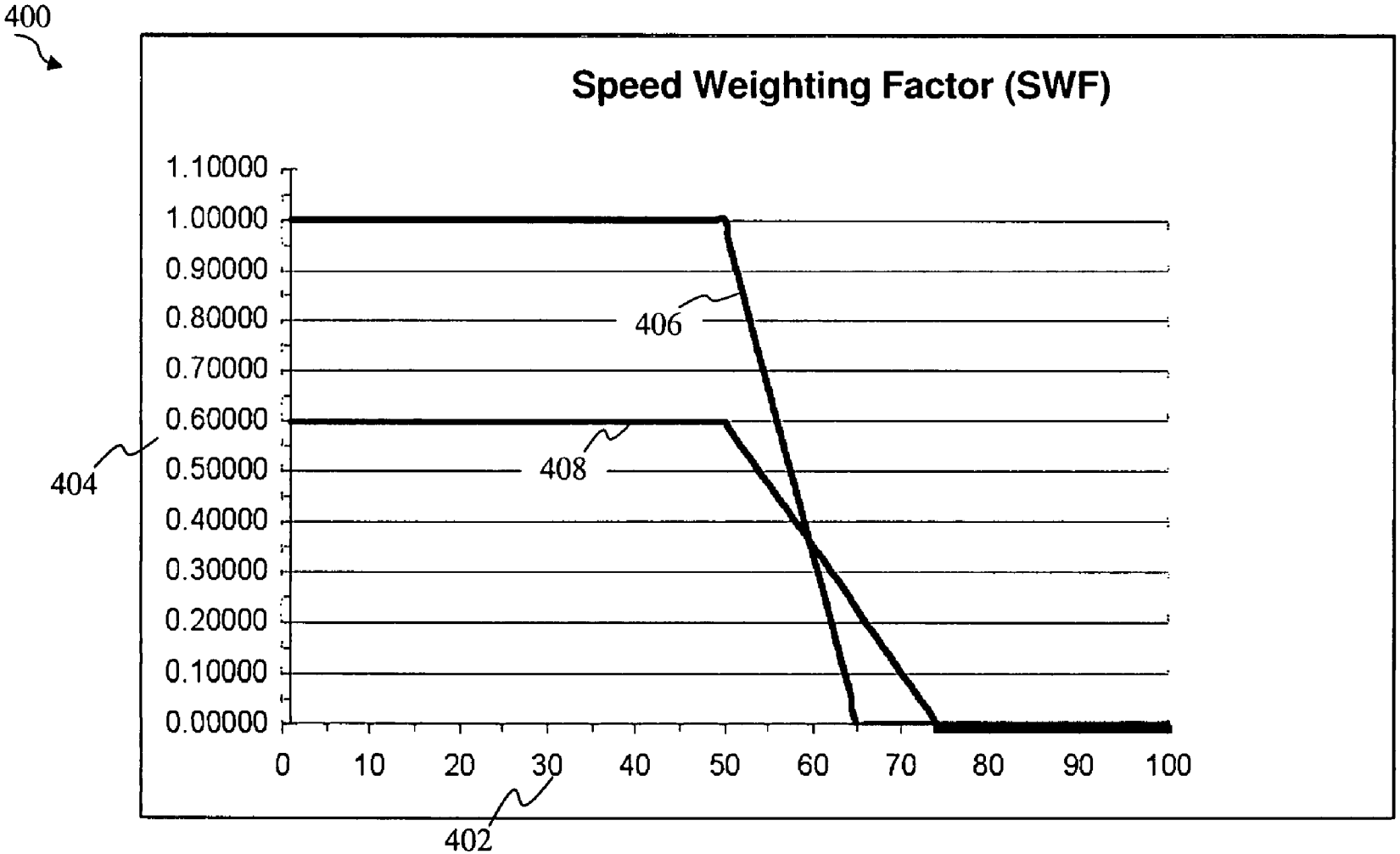
FIG. 5 illustrates a relationship between traffic speed and a speed weighting factor that may be used in dynamic pricing for toll lanes in FIG. 1.

Referring also to FIG. 5, illustrated is a graph 400 showing the relationship between traffic speed 402 and the Speed Weighting Factor 404. The graph 400 may be used to determine the Speed Weighting Factor (SWF) for a particular traffic speed value. It should be noted that the Speed Weighting Factor (SWF) is also sensitive to the current value of traffic speed. Accordingly, changes at a traffic speed near the optimum speed (So) condition are weighted more heavily than changes near the maximum traffic speed (Smax) condition. To alleviate abrupt decreases in the toll rate caused by unstable conditions, the graph 400 includes a function 406 that is used when the change in traffic speed (S') indicates that traffic speed is decreasing, and a function 408 that is used when the change in traffic speed (S') indicates that traffic speed is increasing. The function 408 may have a maximum value that is defined as a percentage (Sp) of the decreasing SWF function 406. The graph 400 may be represented by the following equations:

if S>=So and S'<=0, $$SWF=(-1/(Smax-So))S+(1-(-1/(Smax-So))So)$$

if S>=So and S'>0, $$SWF=[-Sp/([1+Smax-Sp]-So)]*S(t-1)+[Sp-(-Sp/[(1+Smax-Sp)-So])*So]$$

if S<So, $$SWF=1$$

if S>=Smax, $$SWF=0$$

The following graph 400 represents decreasing (−) SWF and increasing (+) SWF given So=50, Smax=65, and Sp=60%.

As discussed above, the change factors have independent weighting values defined as Weight of vCF ("Wvcf") and Weight of SCF ("Wscf"). Thus, traffic flow can be given more or less emphasis than traffic speed or vice versa. Additionally, a factor ("Tscale") may be used to scale TIM to a value that represents the desired level of change. Accordingly, the TIM may be defined by the following equation:

$$TIM=(vCF*Wvcf+SCF*Wscf)*Tscale, \text{ where } Wvcf+Wscf=1$$

The non-toll lanes 102 (or general purpose ("GP") lane conditions) may be considered in the TIM calculation by using GP traffic information to calculate all values in parallel with the toll lanes 104 (or managed lanes ("ML") values), and use a weighted approach to determine an aggregate TIM value. That is, traffic information for the toll lanes 104 (or managed lanes) are used to calculate all the values required to determine the TIM as defined above (referred to as "TIMml"). And in parallel, traffic information for the non-toll lanes 102 (or general purpose lanes) are used to calculate all the values required to determine the TIM as defined above (referred to as "TIMgp") in a similar manner. The weighting values defined as Weight of Managed Lanes ("Wml") and Weight of General Purpose Lanes ("Wgp") may be used, and thus, the managed lane conditions (toll lanes 104) can be given more or less emphasis than the general purpose lane conditions (non-toll lanes 102) or vice versa. Accordingly, the TIM calculation that considers both managed lane and general purpose lane conditions may be defined by the following equation:

$$TIM=TIMml*Wml+TIMgp*Wgp, \text{ where } Wml+Wgp=1$$

In summary, the dynamic pricing algorithm calculates a toll charge adjustment based on a weighted approach of traffic conditions, such as a traffic flow change factor and a traffic speed change factor, of both the managed lanes (e.g., toll lanes) and general purpose lanes (e.g., non-toll lanes). Accordingly, the flow change factor takes into account the current traffic flow and the previous traffic flow (e.g., vehicles per hour, or other suitable rate at which vehicle pass a point or section of the road system), and the speed change factor takes into account the current traffic speed and the previous traffic speed (e.g., miles per hour, or other suitable rate of motion). The rate of change in traffic flow is a leading indicator to how traffic flow will continue to change and the rate of change in traffic speed is a leading indicator to how traffic speed will continue to change. Thus, the dynamic pricing algorithm is configured to predict oncoming traffic conditions and attempts to control both traffic speed and flow by adjusting the toll rate for single occupancy vehicles using the managed lanes.

Although the dynamic pricing algorithm has been discussed above with various equations, it is understood that the algorithm may be represented by a database or look up table that is stored in memory and processed by the processor. Further, the look up tables may be updated periodically as the toll system is operated on-line and traffic information is collected for an extended period of time. The traffic information that is collected may be analyzed and evaluated to determine the effects of the dynamic pricing algorithm based on evaluating the current states of traffic flow and traffic speed, and the results may be used to tune the dynamic pricing algorithm via different weighting configurations, scaling configurations, and combinations thereof.

What is claimed is:

1. A method executed using a dynamic pricing toll system for determining a toll charge for vehicles traveling on a toll lane, the method comprising:

determining via the toll system a rate of change in traffic flow of vehicles traveling on the toll lane;

determining via the toll system a rate of change in speed of vehicles traveling on the toll lane; and determining via the toll system the toll charge for vehicles traveling on the toll lane using a weighting approach that weights the rate of change in traffic flow by a first factor and weights the rate of change in speed by a second factor, the first factor depending on whether the rate of change in traffic flow is increasing or decreasing, and the second factor depending on whether the rate of change in speed is increasing or decreasing.

2. The method of claim 1, wherein the traffic flow is defined as a rate at which vehicles travel pass a section of the toll lane over a predetermined period of time.

3. The method of claim 1, wherein the speed is defined as an average speed of vehicles traveling on the toll lane.

4. The method of claim 1, wherein the determining via the toll system the change in traffic flow includes determining via the toll system a difference between a current traffic flow and a previous traffic flow.

5. The method of claim 4, wherein the first factor is also dependent on the current traffic flow of vehicles traveling on the toll lane.

6. The method of claim 5, wherein the first factor is greater for a current traffic flow that is proximate an optimum traffic flow than a current traffic flow that is proximate a minimum traffic flow, the optimum traffic flow and the minimum traffic flow being user-defined parameters.

7. The method of claim 1, wherein the determining via the toll system the change in speed includes determining a difference between a current speed and a previous speed.

8. The method of claim 7, wherein the second factor is also dependent on the current speed of vehicles traveling on the toll lane.

9. The method of claim 8, wherein the second factor is greater for a current speed that is proximate an optimum speed than a current speed that is proximate a maximum speed, the optimum speed and the maximum speed being user-defined parameters.

10. A method executed using a dynamic pricing toll system for determining a toll charge for vehicles traveling on a toll lane, the method comprising:

determining via the toll system a rate of change in traffic flow and speed of vehicles traveling on a toll lane;

determining via the toll system a rate of change in traffic flow and speed of vehicles traveling on a non-toll lane that runs parallel with the toll lane;

weighting via the toll system the rate of change in traffic flow and speed of vehicles traveling on the toll lane in relation to a current traffic flow and speed for the toll lane;

weighting via the toll system the rate of change in traffic flow and speed of vehicles traveling on the non-toll lane in relation to a current traffic flow and speed for the non-toll lane; and determining via the toll system the toll charge by combining the weighted rates of change in traffic flow and speed for the toll lane and the weighted rates of change in traffic flow and speed for the non-toll lane.

11. The method of claim 10, wherein the determining the change in traffic flow and speed of vehicles traveling on the toll lane and non-toll lane includes:

determining via the toll system a difference between the current traffic flow and a previous traffic flow; and determining via the toll system a difference between the current speed and a previous speed.

12. The method of claim 11, wherein the weighting the change in traffic flow and speed of vehicles traveling on the toll lane includes:

weighting via the toll system the change in traffic flow of vehicles traveling on the toll lane by a first factor, the first factor depending on whether the change in traffic flow for the toll lane is increasing or decreasing; and weighting via the toll system the change in speed of vehicles traveling on the toll lane by a second factor, the second factor depending on whether the change in speed for the toll lane is increasing or decreasing.

13. The method of claim 12, wherein the weighting the change in traffic flow and speed of vehicles traveling on the non-toll lane includes:

weighting via the toll system the change in traffic flow of vehicles traveling on the non-toll lane by a third factor, the third factor depending on whether the change in traffic flow for the non-toll lane is increasing or decreasing; and weighting via the toll system the change in speed of vehicles traveling on the non-toll lane by a fourth factor, the fourth factor depending on whether the change in speed for the non-toll lane is increasing or decreasing.

14. The method of claim 10, wherein the traffic flow is defined as a rate at which vehicles travel pass a section of the toll lane or non-toll lane over a predetermined period of time;

wherein the speed is defined as an average speed of vehicles.

15. A toll system comprising:

a first sensor for sensing a traffic flow of vehicles traveling on a toll lane;

a second sensor for sensing a speed of vehicles traveling on the toll lane; and a controller operatively coupled to the first and second sensors for receiving information regarding the traffic flow and the speed, of vehicles traveling on the toll lane and configured to:

determine a rate of change in the traffic flow of vehicles traveling on the toll lane;

determine a rate of change in the speed of vehicles traveling on the toll lane; and determine a toll charge for vehicles traveling on the toll lane using a weighting approach that weights the rate of change in the traffic flow by a first factor and weights the rate of change in the speed by a second factor, the first factor depending on whether the rate of change in traffic flow is increasing or decreasing, and the second factor depending on whether the rate of change in speed is increasing or decreasing.

16. The toll system of claim 15, wherein the change in the traffic flow of vehicles traveling on the toll lane is defined as a difference between a traffic flow determined at a current point in time and a traffic flow determined at a previous point in time; and wherein the change in the speed of vehicles traveling on the toll lane is defined as a difference between a speed determined at the current point in time and a speed determined at the previous point in time.

17. The toll system of claim 16, wherein the first factor is also dependent on the current traffic flow of vehicles traveling on the toll lane; and wherein the second factor is also dependent on the current speed of vehicles traveling on the toll lane.

18. The toll system of claim 17, wherein the first factor is greater for a current traffic flow near an optimum traffic flow as compared to a current traffic flow near a minimum traffic flow, the optimum traffic flow and minimum traffic flow being user-defined parameters;

wherein the second factor is greater for a current speed near an optimum speed as compared to a current speed near a maximum speed, the optimum speed and maximum speed being user-defined parameters.

19. The toll system of claim 15, further comprising:

a third sensor for sensing a traffic flow of vehicles traveling on a non-toll lane; and a fourth sensor for sensing a speed of vehicles traveling on the non-toll lane;

wherein the controller is operatively coupled to the third and fourth sensors for receiving information regarding the traffic flow and the speed of vehicles traveling on the non-toll lane and configured to:

determine a rate of change in the traffic flow of vehicles traveling on the non-toll lane;

determine a rate of change in the speed of vehicles traveling on the non-toll lane;

weight the change in traffic flow of vehicles traveling on the non-toll lane by a third factor, the third factor depending on whether the rate of change in traffic flow for the non-toll lane is increasing or decreasing;

weight the rate of change in speed of vehicles traveling on the non-toll lane by a fourth factor, the fourth factor depending on whether the rate of change in speed for the non-toll lane is increasing a decreasing; and determine the toll charge by combining the weighted rate of change in traffic flow and speed for the toll lane and the weighted rate of change in traffic flow and speed for the non-toll lane.

20. The toll system of claim 19, wherein the change in the traffic flow of vehicles traveling on the non-toll lane is defined as a difference between a traffic flow determined at a current point in time and a traffic flow determined at a previous point in time; and wherein the change in the speed of vehicles traveling on the non-toll lane is defined as a difference between a speed determined at the current point in time and a speed determined at the previous point in time.

21. A method executed using a dynamic pricing toll system for determining a toll charge for vehicles traveling on a toll lane, the method comprising:

determining via the toll system a rate of change in traffic flow of vehicles traveling on the toll lane, the traffic flow being defined as a rate at which vehicles travel pass a section of the toll lane over a predetermined period of time;

determining via the toll system a rate of change in speed of vehicles traveling on the toll lane, the speed being defined as an average speed of vehicles traveling on the toll lane;

predicting oncoming traffic conditions via the toll system using a weighting approach that weights the rate of change in traffic flow by a first factor and weights the rate of change in speed by a second factor, the first factor depending on whether the rate of change in traffic flow is increasing or decreasing, and the second factor depending on whether the rate of change in speed is increasing or decreasing; and determining via the toll system the toll charge for vehicles traveling on the toll lane based on the predicted oncoming traffic conditions.

22. The method of claim 21, wherein the first factor is also dependent on the current traffic flow of vehicles traveling on the toll lane, and the second factor is also dependent on the current speed of the vehicles traveling on the toll lane.

* * * * *

US008149139C1

(12) EX PARTE REEXAMINATION CERTIFICATE (9796th)

United States Patent

Coffee et al.

(10) Number: US 8,149,139 C1

(45) Certificate Issued: Aug. 13, 2013

(54) DYNAMIC PRICING FOR TOLL LANES

(75) Inventors: Brett Coffee, Rockwall, TX (US); Marty Lain, Sachse, TX (US)

(73) Assignee: The F&M Bank & Trust Company, Dallas, TX (US)

Reexamination Request:
No. 90/012,490, Sep. 11, 2012

Reexamination Certificate for:

| | |
|---|---|
| Patent No.: | **8,149,139** |
| Issued: | **Apr. 3, 2012** |
| Appl. No.: | **12/476,355** |
| Filed: | **Jun. 2, 2009** |

Related U.S. Application Data

(60) Provisional application No. 61/058,141, filed on Jun. 2, 2008.

(51) Int. Cl.
*G08G 1/00* (2006.01)

(52) U.S. Cl.
USPC ..... 340/928; 701/118; 701/119; 705/13

(58) Field of Classification Search
None
See application file for complete search history.

(56) References Cited

To view the complete listing of prior art documents cited during the proceeding for Reexamination Control Number 90/012,490, please refer to the USPTO's public Patent Application Information Retrieval (PAIR) system under the Display References tab.

*Primary Examiner* — Michelle Tarae

(57) ABSTRACT

The present invention provides a method and system for determining a toll charge for vehicles traveling on a toll lane that includes determining a change in traffic flow for vehicles traveling on the toll lane, determining a change in traffic speed for vehicles traveling on the toll lane, and determining the toll charge for vehicles traveling on the toll lane using a weighting approach that weights the change in traffic flow with a first factor and weights the change in speed with a second factor, the first factor depending on whether the change in traffic flow is increasing or decreasing, and the second factor depending on whether the change in speed is increasing or decreasing.

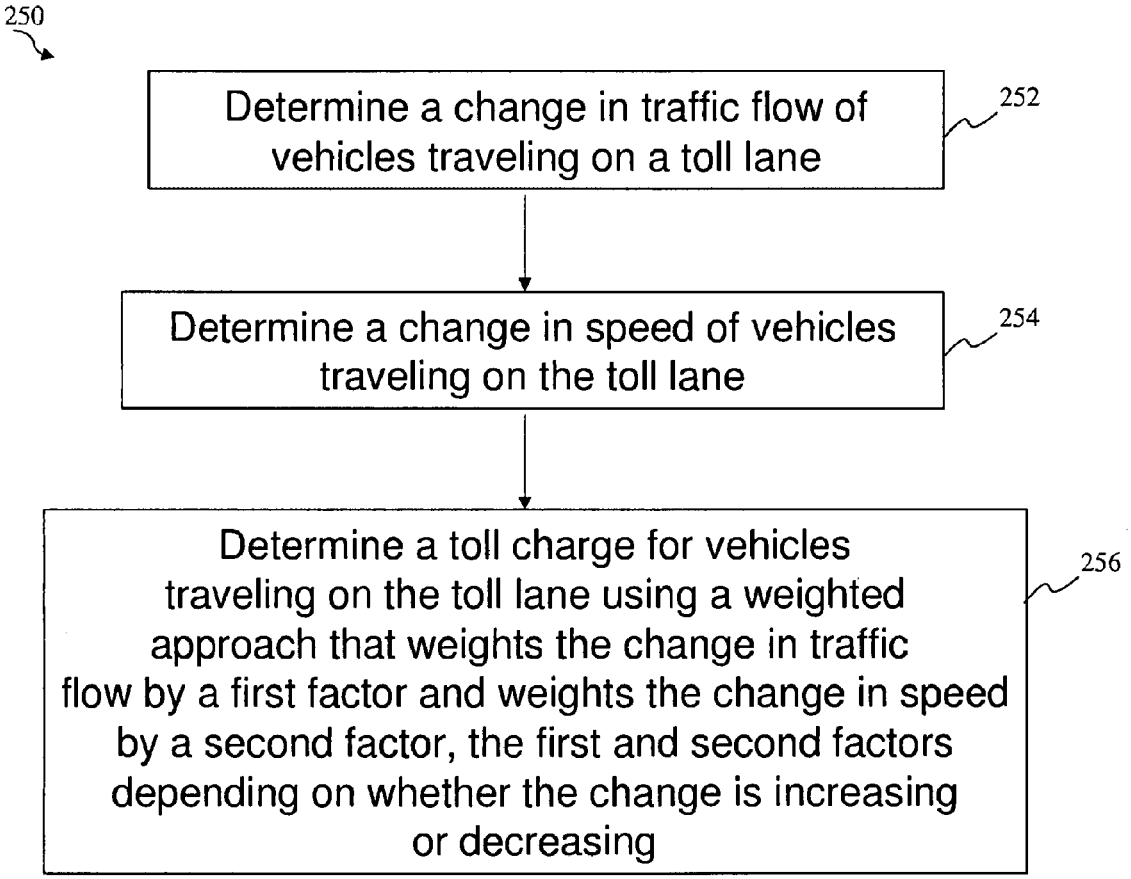

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, 10, 15 and 21 is confirmed.

Claims 2-9, 11-14, 16-20 and 22 were not reexamined.

* * * * *